US007861561B2

(12) United States Patent
Briscoe et al.

(10) Patent No.: US 7,861,561 B2
(45) Date of Patent: Jan. 4, 2011

(54) PORTABLE WRINGER

(76) Inventors: Ronnie L. Briscoe, 1539 Mesquite St., Wichita Falls, TX (US) 76302; Trish J. Briscoe, 1539 Mesquite St., Wichita Falls, TX (US) 76302

( * ) Notice: Subject to any disclaimer, the term of this patent is extended or adjusted under 35 U.S.C. 154(b) by 1007 days.

(21) Appl. No.: 11/612,143

(22) Filed: Dec. 18, 2006

(65) Prior Publication Data

US 2008/0141733 A1 Jun. 19, 2008

(51) Int. Cl.
*D06F 45/24* (2006.01)
*D06F 45/00* (2006.01)

(52) U.S. Cl. ..... 68/244; 68/236; 68/238; 68/239; 68/241; 68/248

(58) Field of Classification Search ..... 68/236, 68/238, 239, 241, 242, 244, 245, 247, 248, 68/250
See application file for complete search history.

(56) References Cited

U.S. PATENT DOCUMENTS 1,605,855 A * 11/1926 Seeds ..... 68/272
2,144,793 A * 1/1939 Christensen ..... 68/244
3,441,973 A 5/1969 Turk
4,754,518 A * 7/1988 Griffin ..... 15/262
5,193,364 A 3/1993 Leenders
6,161,807 A * 12/2000 Steiner et al. ..... 248/166
6,571,586 B1 6/2003 Ritson et al.

* cited by examiner

*Primary Examiner*—Joseph L Perrin
*Assistant Examiner*—Benjamin Osterhout
(74) *Attorney, Agent, or Firm*—Dale J. Ream

(57) ABSTRACT

A portable wringer includes a housing having upper and lower ends and defining an open interior area therebetween. The portable wringer also includes first and second rollers positioned inside the open interior area, the first and second rollers being accessible through the housing and movable relative to one another so as to cooperatively pass an item therebetween. A crank handle is operatively connected to the rollers for causing at least one of the rollers to rotate. A plurality of legs are coupled to the housing adjacent the lower end of the housing with each leg being pivotable between a storage configuration and a deployed configuration. The legs may be telescopic for length adjustment thereof. The portable wringer includes a removable tray positionable in the housing beneath the first and second rollers for collecting a liquid initially associated with the item passed between the rollers.

2 Claims, 4 Drawing Sheets

PORTABLE WRINGER

BACKGROUND OF THE INVENTION

The present invention relates generally to cleaning devices and, more particularly, to a portable wringer for drying a chamois or other towel when drying a washed vehicle.

Many people spend much time, energy, and resources maintaining their vehicles in a clean condition. A very important step in maximizing the vehicle's appearance is thoroughly drying the vehicle after washing it in order to eliminate unsightly water spots. Unfortunately, the chamois must sometimes be dried during the drying process in order to be effective.

Although many commercial car washes provide wringers for wringing out a wet chamois are known in the art, these products are not available to a person who desires to wash and dry their vehicle at home or at a car wash not having a chamois wringer. In addition, the existing devices do not provide legs that are collapsible or rotatable and do not provide convenient and removable water collection trays.

Therefore, it would be desirable to have a portable wringer that is conveniently available for an individual consumer to use. Further, it would be desirable to have a portable wringer with collapsible legs so that the wringer may easily be transported, used, and stored. In addition, it would be desirable to have a portable wringer having a removable tray for collecting water.

SUMMARY OF THE INVENTION

A portable wringer according to the present invention includes a housing having upper and lower ends and defining an open interior area therebetween. The portable wringer also includes first and second rollers positioned inside the open interior area, the first and second rollers being accessible through the housing and movable relative to one another so as to cooperatively pass an item therebetween. A crank handle is operatively connected to the rollers for causing at least one of the rollers to rotate. A plurality of legs are coupled to the housing adjacent the lower end of the housing with each leg being pivotable between a storage and a deployed configuration. The legs may be telescopic for length adjustment thereof. The portable wringer includes a removable tray positionable in the housing beneath the first and second rollers for collecting a liquid initially associated with the item passed between the rollers.

Therefore, a general object of this invention is to provide a portable wringer having a pair of rotatable rollers for wringing wetness from a chamois while drying a vehicle.

Another object of this invention is to provide a portable wringer, as aforesaid, having a plurality of legs to support the rollers above a ground surface, the legs being pivotally movable between a storage configuration and a deployed configuration.

Still another object of this invention is to provide a portable wringer, as aforesaid, in which the legs are length adjustable.

Yet another object of this invention is to provide a portable wringer, as aforesaid, having a removable tray for collecting water from the housing.

A further object of this invention is to provide a portable wringer, as aforesaid, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
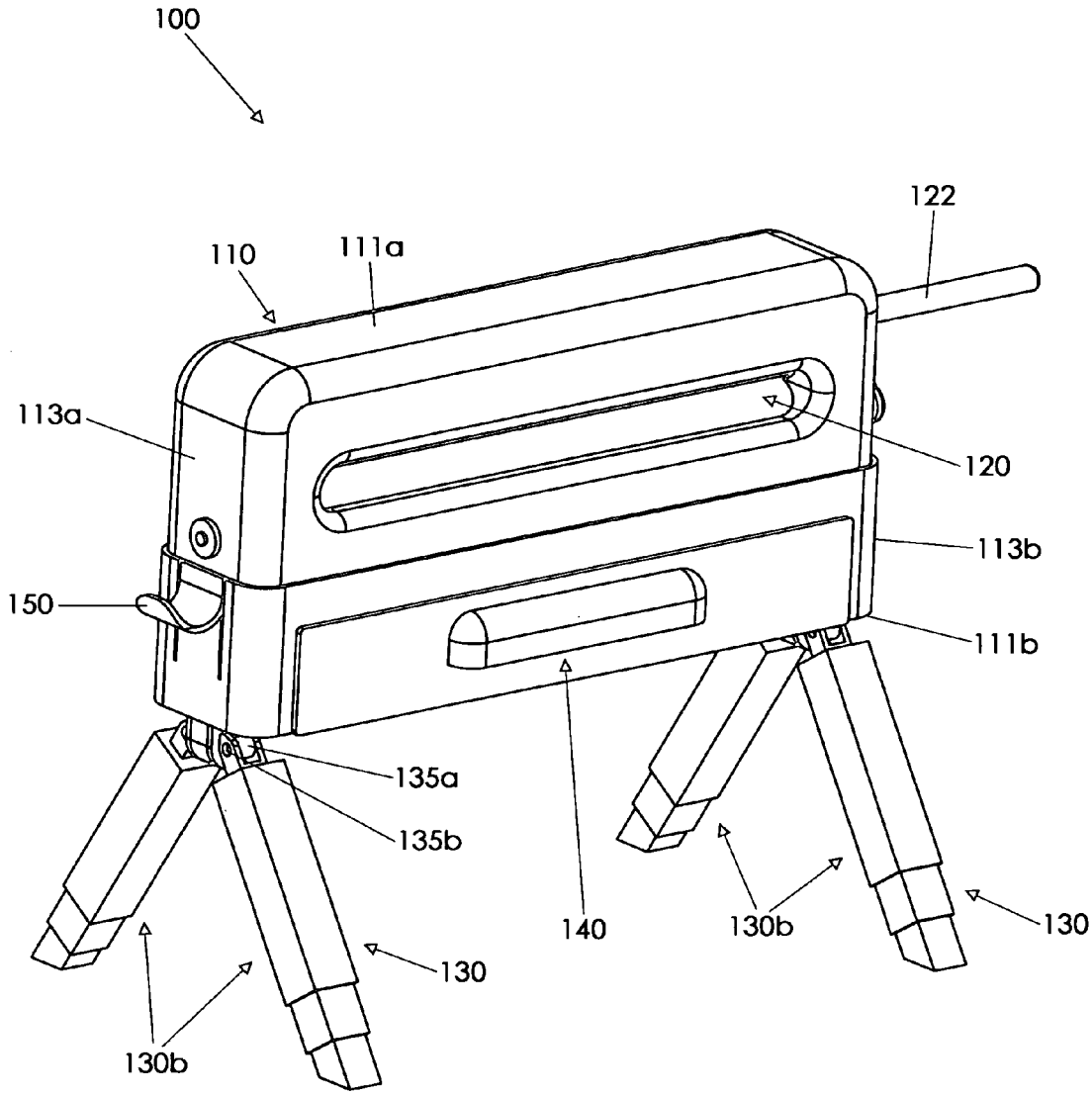
FIG. 1 is a perspective view of a portable wringer according to a preferred embodiment of the present invention with the legs at a retracted configuration.

A portable wringer 100 according to the present invention will now be described in detail with reference to FIGS. 1 through 4 of the accompanying drawings. More particularly, a portable wringer 100 according to the current invention includes a housing 110, at least two rollers 120, and a plurality of legs 130.

The housing 110 has upper and lower ends 111*a*, 111*b* (FIG. 1) and defines an open interior area 112 (FIG. 4) between the ends 111*a*, 111*b*. The housing 110 also has opposed first and second sides 113*a*, 113*b* and may be constructed from composite, metal, wood, or any other suitable material. The housing 110 may be elongate and have a length suitable for containing the rollers 120.

Figure 4:
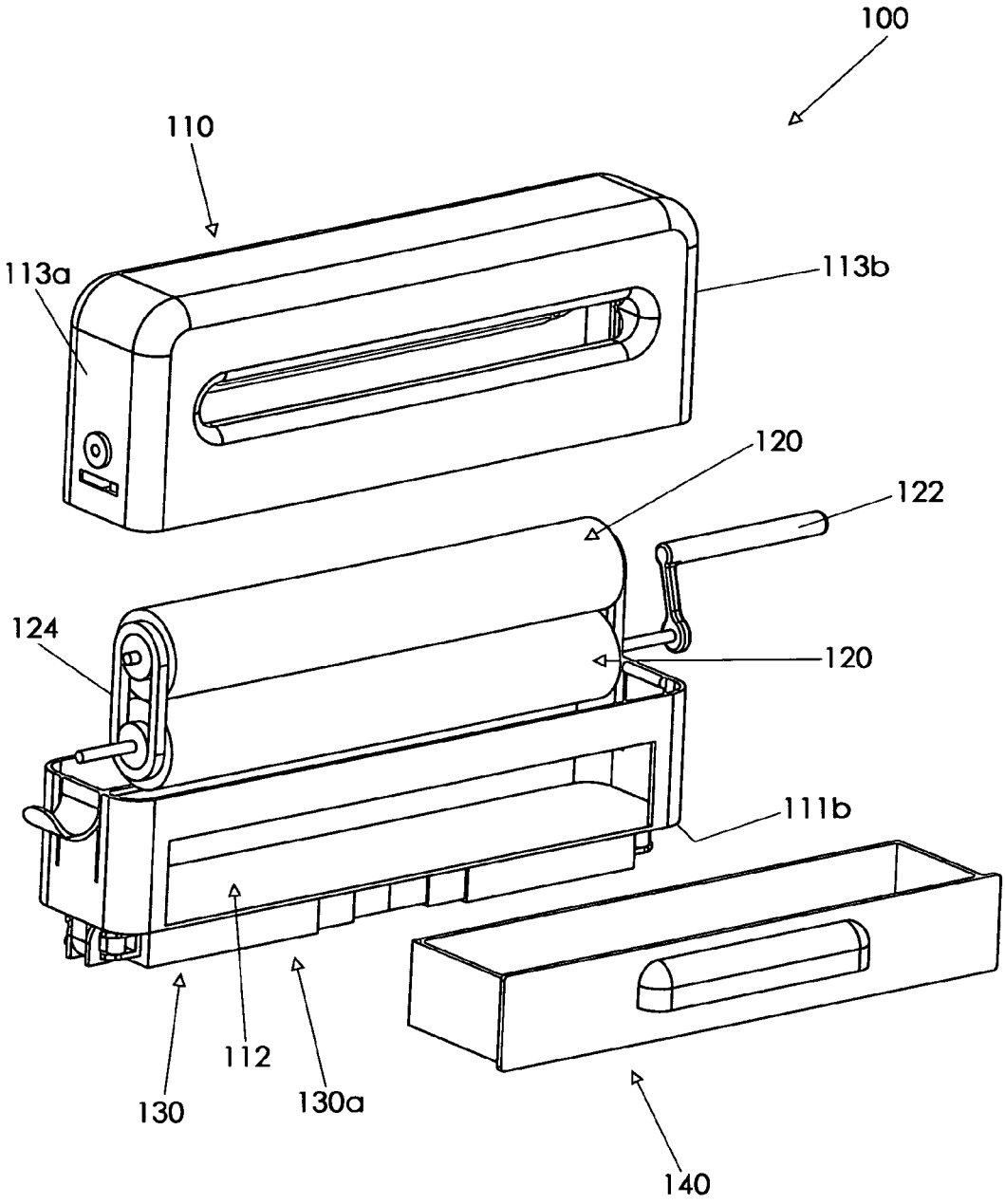
FIG. 4 is a another view of the portable wringer as in FIG. 3 with the legs in a deployed configuration.

As shown in FIGS. 1 and 4, the rollers 120 may be positioned inside the open interior area 112 between the first and second sides 113*a*, 113*b* and accessible through the housing 110. The rollers 120 are generally parallel to one another and movable relative to one another to cooperatively pass an item (e.g., a chamois) therebetween. Means for rotating the rollers 120 may be included. More particularly, a crank 122 may be operatively coupled to one roller 120, and a driving member 124 (also referred to herein as a tension member) may be operatively coupled to each roller 120 to associate the rollers 120 together so that rotation of one roller 120 causes rotation of each other roller 120. The driving member 124 may be, for example, a belt, a chain, or another appropriate device.

Figure 2:
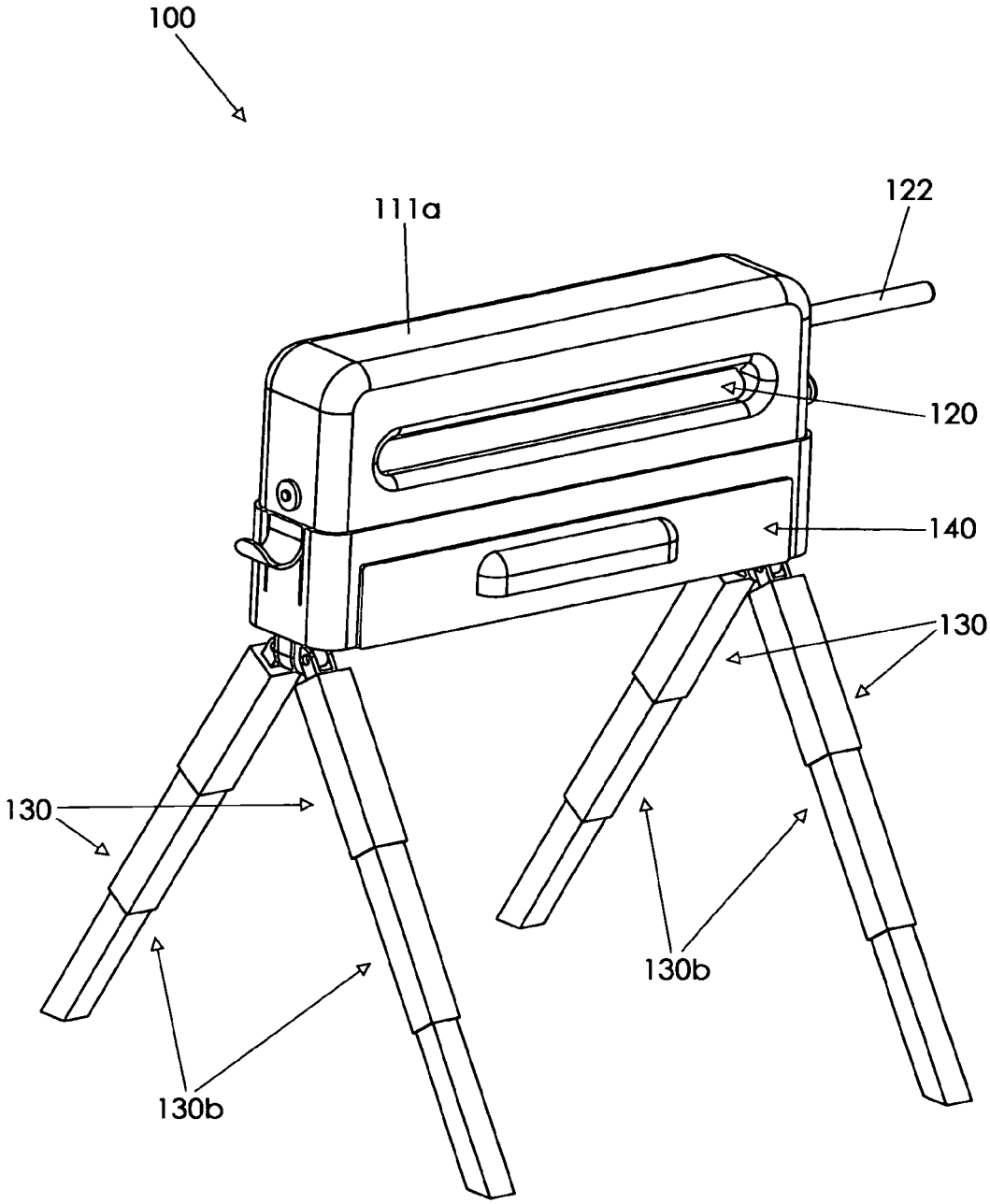
FIG. 2 is another perspective view of the portable wringer as in FIG. 1 with the legs at an extended configuration.
Figure 3:
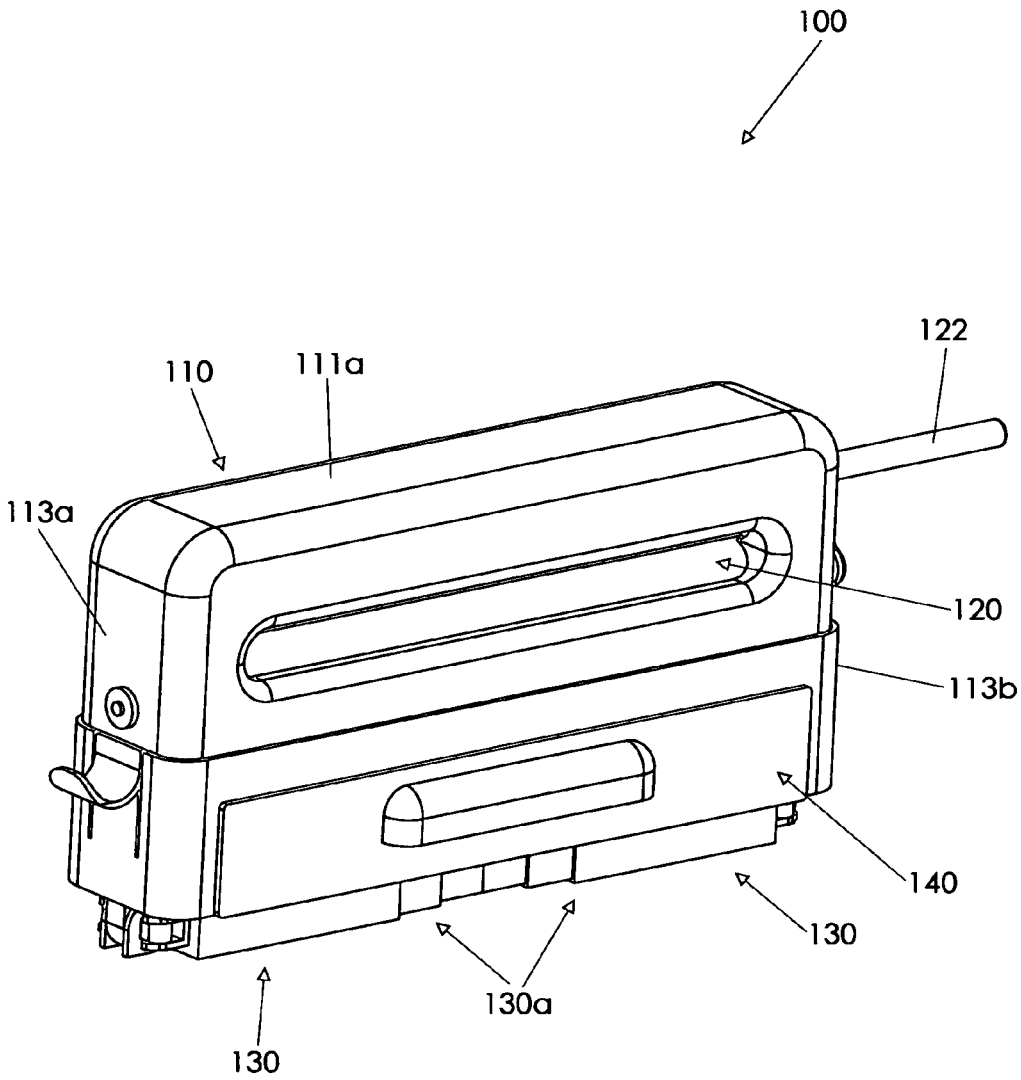
FIG. 3 is a perspective view of the portable wringer with the legs in a storage configuration.

The legs 130 may be coupled to the housing 110 adjacent the lower end 111*b*. As shown throughout the accompanying drawings, at least two legs 130 may be coupled to the housing 110 adjacent the first side 113*a*, and at least two legs 130 may be coupled to the housing 110 adjacent the second side 113*b*. The legs 130 are respectively pivotable between a storage configuration 130*a* (FIGS. 3 and 4) and a deployed configuration 130*b* (FIGS. 1 and 2). As shown by comparing FIG. 1 to FIG. 2, each leg 130 may be telescopic and include means for selectively maintaining a plurality of lengths, such as a clamping or pinning device.

When at the storage configuration 130*a*, each leg 130 may extend generally parallel to the rollers 120, or in other words, generally along the length of the housing 110. When at the deployed configuration 130*b*, the legs 130 may be rotatable to selectively vary a distance between the housing 110 and a ground surface (or in other words to raise or lower the housing 110) without adjusting respective lengths of the legs 130. More particularly, the legs 130 adjacent the first side 113*a* may be rotatable toward one another when at the deployed configuration 130*b*, and the legs 130 adjacent the second side 113*b* may be rotatable toward one another when at the deployed configuration 130*b*. As shown in FIG. 1, each leg 130 may be coupled to the housing 110 by two rotatable members 135*a*, 135*b*. The first rotatable members 135*a* may allow the legs 130 to move between the storage configuration 130*a* and the deployed configuration 130*b*, while the second rotatable members 135*b* may allow the legs 130 to move toward one another as described above.

A removable tray 140 may be positionable in the housing 110 beneath the rollers 120. The tray 140 may be generally rectangular and selectively cover a majority of the lower end 111*b* of the housing 110 as shown in the accompanying figures, or other shapes and sizes may be used. A towel hook 150 may be coupled to the housing 110, such as at side 113*a* as shown in FIG. 1.

In use, the legs 130 may be initially at the storage configuration 130*a*. The legs 130 may be pivoted away from the housing 110 to the deployed configuration 130*b* to raise the housing 110, and the legs 130 may be lengthened as described above. Once the legs 130 are at the deployed configuration 130*b*, they may be pivoted away from one another as described above to provide stability and further modify the height of the housing 110. An item such as a chamois may be introduced to the rollers 120, and the crank 122 and driving member 124 may be used as described above to feed the chamois through the rollers 120, squeezing out moisture in the process. The moisture may be collected in the tray 140 and emptied when desired. When not in use, the legs 130 may be pivoted toward one another and then pivoted toward the housing 110 to return to the storage configuration 130*a*.

It is understood that while certain forms of this invention have been illustrated and described, it is not limited thereto except insofar as such limitations are included in the following claims and allowable functional equivalents thereof.

What is claimed is as follows:

1. A portable wringer, comprising:

a housing having upper and lower ends and defining an open interior area therebetween;

first and second rollers positioned inside said open interior area, said first and second rollers being accessible through the housing and movable relative to one another to cooperatively pass an item therebetween;

a crank operatively coupled to said first and second rollers to associate said first and second rollers together, whereby rotation of said first roller causes rotation of said second roller;

a removable tray positionable in said housing beneath said first and second rollers for collecting a liquid initially associated with said item;

a plurality of telescopic legs coupled to said housing adjacent said lower end, each said leg being pivotable between a storage configuration and a deployed configuration;

wherein:

said housing includes opposed first and second sides;

said first and second rollers are positioned between said first and second sides;

at least two said legs are coupled to said housing adjacent said first side;

at least two said legs are coupled to said housing adjacent said second side;

said at least two legs adjacent said first side are rotatable toward one another when at said deployed configuration;

said at least two legs adjacent said second side are rotatable toward one another when at said deployed configuration; and wherein each said leg is coupled to said housing by first and second rotatable members, said first rotatable member being configured to enable said legs to move between said storage configuration and said deployed configuration, said second rotatable member enabling respective legs to selectively move toward or away from one another so as to adjust the height of said housing without adjusting a length of said legs.

2. The portable wringer of claim 1, wherein:

said first roller is situated generally parallel to said second roller; and each said leg extends generally parallel to said first roller when at said storage configuration.

* * * * *